United States Patent [19]

Richards

[11] Patent Number: 4,974,844

[45] Date of Patent: Dec. 4, 1990

[54] GAME BALL

[76] Inventor: Marvin D. Richards, 418 Del Sol, Pleasanton, Calif. 94566

[21] Appl. No.: 410,756

[22] Filed: Sep. 22, 1989

[51] Int. Cl.[5] ..... A63B 43/02; A63B 37/06; A63B 37/12

[52] U.S. Cl. ..... 273/58 BA; 273/58 K; 273/DIG. 20; 273/58 D

[58] Field of Search ..... 273/58 K, 58 R, 58 A, 273/58 B, 58 BA, 58 D, 58 J, DIG. 20; 428/11

[56] References Cited

U.S. PATENT DOCUMENTS

| | | | |
|---|---|---|---|
| 115,252 | 5/1871 | Spencer | 273/58 K |
| 513,560 | 1/1894 | Dickey | 273/58 K |
| 2,266,427 | 12/1941 | Hawes | 273/58 K |
| 2,814,159 | 11/1957 | Green | 273/58 K |
| 3,185,476 | 5/1965 | Fechner | 273/58 K |
| 4,131,276 | 12/1978 | Judkins | 273/58 K |
| 4,219,959 | 9/1980 | Fleischer | 273/58 D |

FOREIGN PATENT DOCUMENTS

| | | | |
|---|---|---|---|
| 963098 | 5/1957 | Fed. Rep. of Germany | 273/58 K |

*Primary Examiner*—George J. Marlo
*Attorney, Agent, or Firm*—Bielen, Peterson & Lampe

[57] ABSTRACT

A ball structure utilizing a plurality of annular elements or disk-like members placed in side-by-side disposition with one another. Each of the members are constructed of soft, flexible, foam material. The side-by-side members are bound together at one place to cause compression of the foam material. The side-by-side members are bound at a second place along each of the annular members substantially opposite to the first binding place. Such dual binding causes compression of the soft flexible foam material forming the annular members into a ball.

11 Claims, 2 Drawing Sheets

GAME BALL

BACKGROUND OF THE INVENTION

The present invention relates to a novel structure for a toroidal ball.

Many games enjoyed by men and women employ playing games with objects such as balls. Many of these balls are hard, requiring protective mitts and open space to prevent damage to structures and objects, as well as persons in the vicinity the ball game.

Foam plastic material has been used the construction of balls which may be employed in such games as baseball, football, basketball, and the like. Such foam constructed balls have found great acceptance in indoor in confined spaces. Likewise, children may safely play with such balls without the possibility of injuring one another.

U.S. Pat. No. 4,219,959 describes a ball which may be formed of flexible material and is formed by using a pair of intertwined helices which are fastened to one another. U.S. Pat. No. 4,131,276 and German patent No. 963,098 describe a ball-like object which is formed by binding the foam members in a central region on a retaining rod.

U.S. Pat. Nos. 115,252 and 513,560 describe ball-like structures which are form by fastening semi-circular rings or hoops together.

A spheroidal object such as a ball which is form by foam material in an integral format would be a notable advance in the field of games and athletics.

SUMMARY OF THE INVENTION

In accordance with the present invention a novel and useful ball of spheroidal shape is provided.

The ball of the present invention employs a plurality of annular or disk-like members in side-by-side disposition. The members may possess a circular, rectangular, ring, triangular, polygonal or other cross-sectional configurations. The surfaces of the members may be flat or bulging, as desired, each producing a ball of particular form and shape for a particular use.

The plurality of members and side-by-side disposition are all constructed of soft, flexible material such as plastic foam. First means is employed for binding the side-by-side members together to cause compression of the soft flexible material at one point. The second means is also employed for binding the side-by-side members together at a place substantially opposite to the first binding means. Again, the second binding means causes compression of the soft flexible foam-like material to determine the shape of the ball. The ball may be spherical, oval, or any spheroidal shape, oblate, prolate, or otherwise. For example, the ball may take the shape of a football employed in that game.

It may be apparent that a novel and useful ball of spheroidal shape has been described.

It is therefore an object of the present invention to provide a ball of spheroidal shape which is constructed of soft foam-like material and is safe for use in confined spaces and safe for employment by children.

Another object of the present invention is to provide a ball constructed of soft foam-like material which is simple to grip when playing the ball game.

Yet another object of the present invention is to provide a ball of soft foam-like material which is relatively simple to manufacture.

Yet another object of the present invention is to provide a ball of soft foam-like material which is composed of a plurality of elements bound together, yet possessing the attributes of a ball formed of a unitary piece of foam-like material.

The invention possesses other objects and advantages especially as concerns particular characteristics and features thereof which will become apparent as the specification continues.

Figure 1:
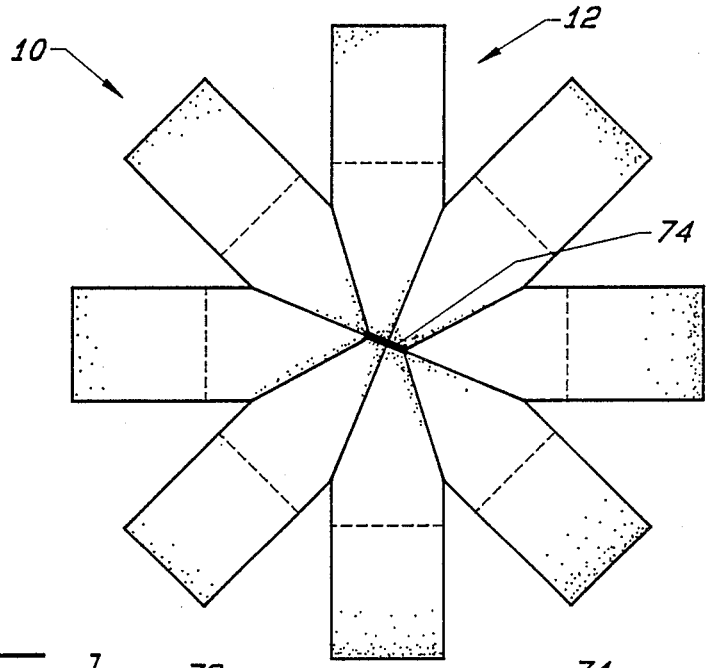
FIG. 1 is a top plan view of a ball of the present invention utilizing a particular annular member.

For a better understanding of the invention reference is made to the following detailed description of the preferred embodiments which should be referenced to the hereinabove described drawings.

DESCRIPTION OF THE PREFERRED EMBODIMENTS

Various aspects of the present invention will evolve from the following detailed description of the preferred embodiments which should be taken in conjunction with the prior described drawings.

The invention as a whole is shown in the drawings by reference character 10. The ball or spheroidal object 10 is constructed of a plurality of soft foam-like elements 12. Such material may be polyurethane foam, natural or synthetic rubber, vinyl, or similar material.

Figure 5:
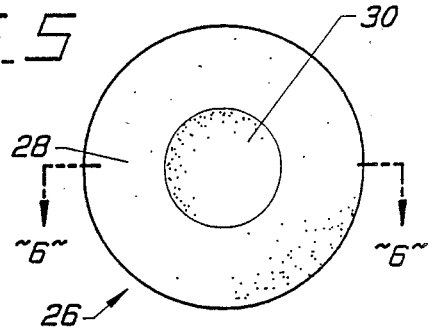
FIG. 5 is a front elevational view of an annular member which may be constructed with like annular members into the ball of the present invention.
Figure 6:
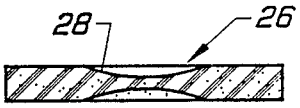
FIG. 6 is a sectional view taken along line 6—6 of FIG. 5.
Figure 7:
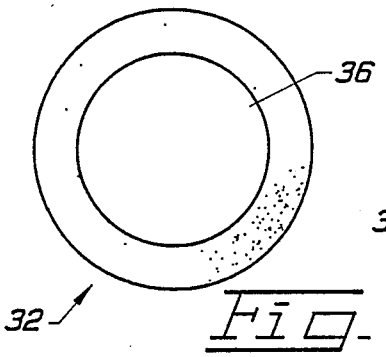
FIG. 7 is an example of another annular member which may be employed with like annular members to construct the ball of the present invention.
Figure 8:
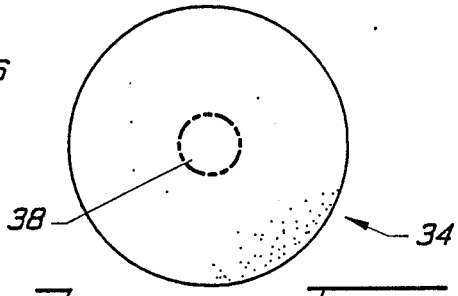
FIG. 8 is an example of another member which may be employed with like annular members to construct the ball of the present invention, showing a removed section in phantom.
Figure 9:
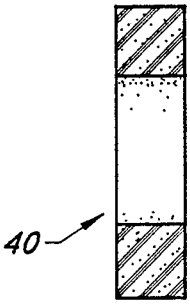
FIGS. 9–12 are sectional views showing annular members which may be utilized to construct the ball of the present invention.
Figure 10:
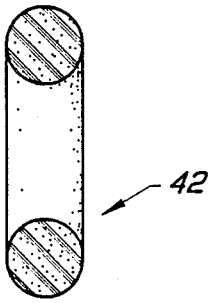
Figure 11:
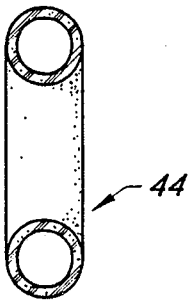
Figure 12:
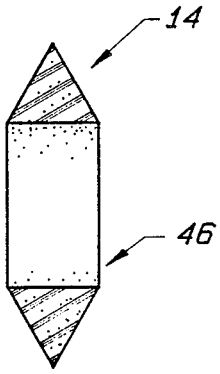

Elements 12 may take the form of a plurality plastic foam annular members 14, such as those shown on FIGS. 3, 5–12, or plurality of disk-like members 16 illustrated in FIGS. 13–17. For example FIG. 3 describes an annular member 18 having a ring structure 20 formed about a central opening 22. The outer edge surface 24 of annular member 18 is relatively flat, although this is not deemed to be a restriction on the present invention. With reference to FIGS. 5 and 6, it may be seen that annular member 26 is depicted therein having a scalloped or removed portion 28 near the central cavity 30. FIGS. 7 and 8 illustrate annular members 32 and 34 which may include a large central opening 36 and a relatively small central opening 38, respectively. It should be noted that annular member 34 is shown with a partial central opening 38 which will be discussed hereinafter. FIGS. 9–12 picture, in section, annular members 40, 42, 44, and 46 which may also be employed in the ball 10 of the present invention. Annular member 44, FIG. 11, may be air-filled and sealed.

Figure 15:
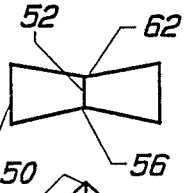
FIG. 15 is a top plan view of the disk-like member of FIG. 13.
Figure 13:
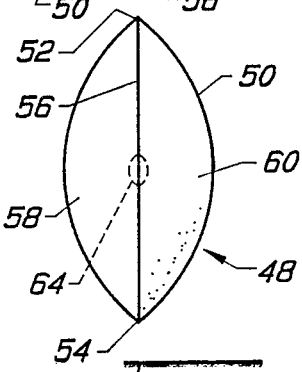
FIG. 13 is a front elevational view of a disk-like member which may be employed to construct the ball of the present invention.
Figure 14:
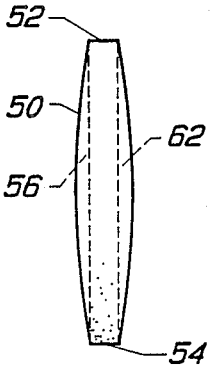
FIG. 14 is a side view of the disk-like member of FIG. 13.
Figure 16:
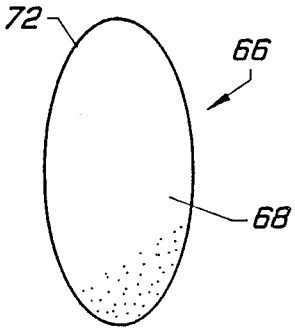
FIG. 16 is a front elevational view of disk-like member which may be used to construct the ball of the present invention.
Figure 17:
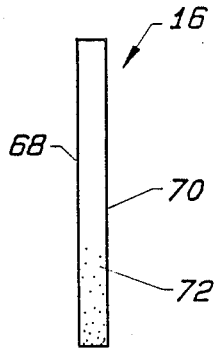
FIG. 17 is an end view of the disk-like member of FIG. 16.

A plurality of foam elements 12 may also take the form of a plurality of disk-like members 16 such as those shown in FIGS. 13–17. FIGS. 13–15 depicts a disk-like element 48 having an outer surface 50 which bulges between ends 52 and 54. With reference to FIG. 13, disk-like member 48 appears to be ovoid in shape, however a crease 56 marks the slope downwardly of side portions 58 and 60 from the bulges on surface 50. Another crease 62 is found on the side opposite that illustrated in FIG. 13. It should be realized, that crease 56 may be nonexistence such that surfaces 58 and 60, and comparable surfaces on the other side of disk-like member 48, merge smoothly. Again, a central opening 64 may be formed in member 48. With reference to FIGS. 16 and 17, a disk-like member 66 is depicted having a pair of oval surfaces 68 and 70 between a flat rectangular edge surface 72. It should be observed that FIG. 8 depicts a circular annular member which may take the form of a circular disk-like member by the removal of central opening 38.

Figure 2:
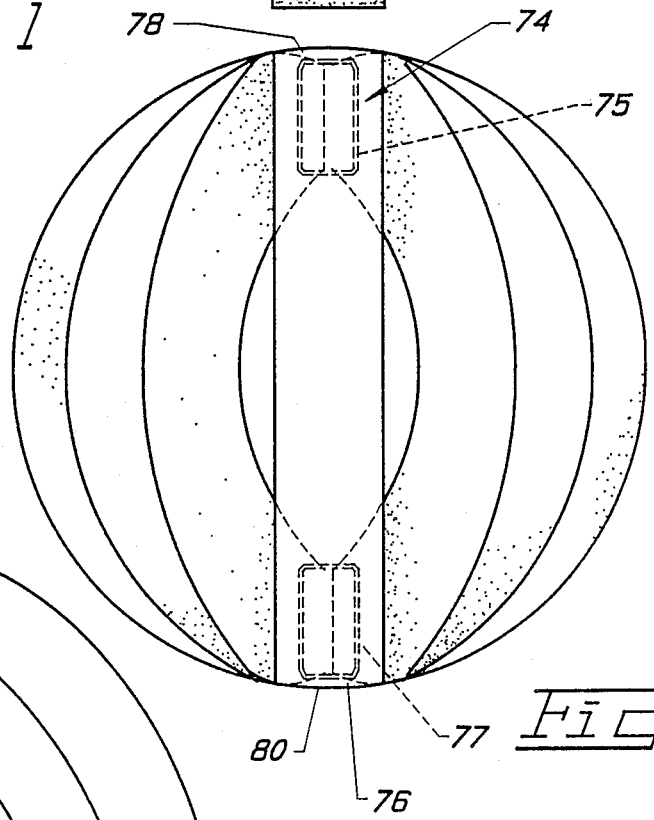
FIG. 2 is a front elevational view of the ball of the present invention represented in FIG. 1 having a portion cut away in the central region revealing the binding means therefore.
Figure 3:
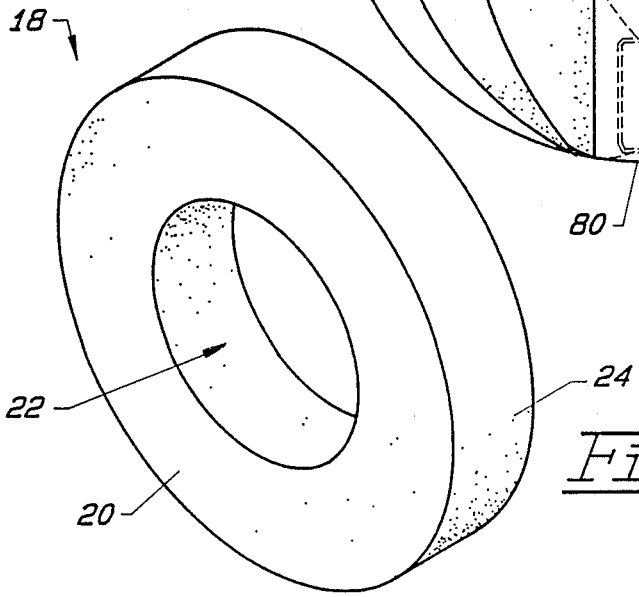
FIG. 3 is a top, right, perspective view of the annular element used to construct the ball depicted in FIGS. 1 and 2.

The invention also includes first binding means 74 which may in the form of a cord 75 which is wrapped or sewn through plurality of foam elements 12 which are initially placed in side-by-side deposition relative to one another Means 74 may also take the form of gluing, welding or the like not utilizing a cord. Annular member 18, FIG. 3, has been used as an example in FIGS. 1 and 2 for forming ball 10, however any of the plurality of annular members 14 or disk-like members 16 may be employed in this regard. Second binding means 76 is employed to cause compression of the soft flexible foam material of plurality of foam elements 12 at a place along the annular member substantially opposite to first means 74 for binding plurality of foam elements 12. Again, second binding means 76 may be in the form of a cord or line 77 which has been tightened or sewn through the foam elements 12. It should be noted that slight depressions 78 and 80 are formed by this process, not detracting appreciably from the generally spheroidal shape of the formed ball 10. The remaining plurality of annular members 14 and disk-like elements 16 may also be formed into balls or spheroidal objects using first and second binding means 74 and 76. As an example, the ovoid and oval disk-like elements depicted in 13–17 would be formed into a prolate or oblate spheroids similar to a football.

Figure 4:
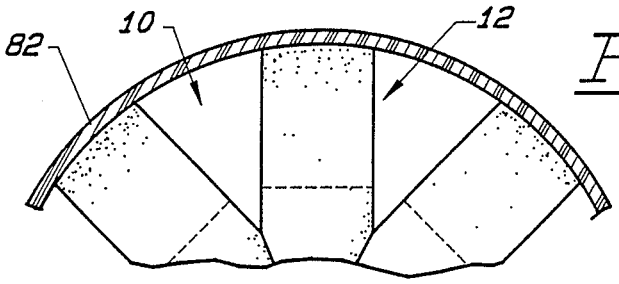
FIG. 4 is a partial sectional view of the ball of the present invention having a cover thereabout.

Turning to FIG. 4, it may be observed that a cover element 82 may be formed over ball 10 to protect the same from moisture, dust, and general wear. In such a format, ball 10 would serve as a core within cover element 82.

Any of the balls or spheroidal elements 10 formed in this invention have been observed to be safe for indoor or confined space usage and are particularly easily manipulated by children, since each of the plurality of the bound annular or disk-like members 14, 16, presents a gripping surface for small hands.

While in the foregoing embodiments of the present invention have been set forth in considerable detail for the purposes of making a complete disclosure of the invention, it may be apparent to those of skill in the art that numerous changes may be made in such details without departing from the spirit and principles of the invention.

What is claimed is:

1. A ball of spheroidal shape comprising;

a. a plurality of elements in side-by-side disposition, said elements being constructed of flexible material and having peripheries;

b. first means for binding said side-by-side elements together at one place in each of the peripheries of said side-by-side elements to cause compression of said flexible material; and c. second means for binding said side-by-side elements together at another place in each of the peripheries of said side-by-side elements, along and away from said one place in each of the peripheries of said side-by-side elements bound by said first means for binding, said second means for binding said side-by-side elements together causing compression of said flexible material.

2. The ball of claim 1 in which said plurality of elements comprises a plurality of disk-like elements.

3. The ball of claim 2 in which said disk-like elements are oval in cross-sectional configuration.

4. The ball of claim 3 in which said disk-like elements include a bulging surface.

5. The ball of claim 1 in which said plurality of elements comprises a plurality of annular members.

6. The ball of claim 5 in which said plurality of annular members possess a circular cross-sectional configuration.

7. The ball of claim 5 in which said plurality of annular members possess a rectangular cross-sectional configuration.

8. The ball of claim 5 in which said plurality of annular members possess an annular cross-sectional configuration.

9. The ball of claim 5 in which said plurality of annular members possess a triangular cross-sectional configuration.

10. The ball of claim 5 in which said plurality of annular members possess a polygonal cross-sectional configuration.

11. The ball of claim 5 which further comprises a cover surrounding said bound plurality of annular members.

* * * * *